US007543650B2

(12) United States Patent
Richardson

(10) Patent No.: US 7,543,650 B2
(45) Date of Patent: Jun. 9, 2009

(54) QUILL SAVER SUB

(75) Inventor: Allan S. Richardson, The Woodlands, TX (US)

(73) Assignee: Canrig Drilling Technology, Ltd., Mangolia, TX (US)

( * ) Notice: Subject to any disclaimer, the term of this patent is extended or adjusted under 35 U.S.C. 154(b) by 0 days.

(21) Appl. No.: 11/405,940

(22) Filed: Apr. 18, 2006

(65) Prior Publication Data

US 2007/0074874 A1 Apr. 5, 2007

Related U.S. Application Data

(60) Provisional application No. 60/672,291, filed on Apr. 18, 2005.

(51) Int. Cl.
*E21B 19/18* (2006.01)

(52) U.S. Cl. ..... 166/379; 166/77.51; 175/320

(58) Field of Classification Search ..... 166/379, 166/77.51; 175/320, 203, 162
See application file for complete search history.

(56) References Cited

U.S. PATENT DOCUMENTS 3,291,225 A * 12/1966 Foran ..... 173/164
3,842,619 A * 10/1974 Bychurch, Sr. ..... 464/182
4,491,346 A * 1/1985 Walker ..... 285/18
4,557,508 A * 12/1985 Walker ..... 285/84
4,981,180 A * 1/1991 Price ..... 173/164
5,044,438 A 9/1991 Young ..... 166/250
5,267,621 A * 12/1993 Deken et al. ..... 175/57
5,544,712 A * 8/1996 McEwen et al. ..... 175/57
5,588,772 A * 12/1996 Johnson, Jr. ..... 403/355
6,220,363 B1 4/2001 Dallas ..... 166/382
6,845,826 B1 * 1/2005 Feld et al. ..... 175/320
7,231,969 B2 * 6/2007 Folk et al. ..... 166/77.51
2005/0274508 A1 * 12/2005 Folk et al. ..... 166/77.52
2005/0279507 A1 * 12/2005 Folk et al. ..... 166/378

OTHER PUBLICATIONS

International App. No. PCT/US 06/14472/ Intl. Search Report and Written Opinion mailed Apr. 18, 2006.

* cited by examiner

*Primary Examiner*—Shane Bomar
(74) *Attorney, Agent, or Firm*—Haynes and Boone, LLP

(57) ABSTRACT

A saver sub assembly has a body capable of coupling with a quill, and a split ring capable of coupling with the quill and the body and capable of keeping the quill and body together. The body has splines to prevent relative rotation between the quill and the body. The body may be hollow, and/or have a split ring retainer to maintain the position of the split ring. The saver sub assembly may also have one or more O-rings positioned between the body and the quill. The body of the saver sub assembly may have a threaded pin for engaging a drill string.

16 Claims, 5 Drawing Sheets

QUILL SAVER SUB

CROSS-REFERENCE TO RELATED APPLICATIONS

This patent application claims the benefit of U.S. Provisional Patent Application Ser. No. 60/672,291, titled "Quill Saver Sub," filed Apr. 18, 2005, and which is incorporated by reference herein in its entirety.

BACKGROUND

The present invention relates to equipment used in well drilling operations including, but not limited to, a top drive, a lower well control valve, a manual valve, and a saver sub. The top drive travels up and down along the torque guide in the mast. The torque guide transmits the drilling reactive torque to the mast. The top drive has a center quill that typically has a threaded connection to attach to the drill string. The quill typically has an API thread at the attachment of the drill string and blow out preventer. The threaded connection is designed to withstand drilling torque, drill string make-up and breakout torque and tensile load generated by lifting the entire weight of the drill string. Depending on the application, over time, the threads of the quill may fail due to fatigue and/or external bending loads. Excessive bending loads and/or material defects in the quill may generate tensile cracks in the threads and cause enormous and costly down time due to a number of factors. First, the down time associated with failure of the quill connection can be significant, as the entire quill must be removed before a re-cut can occur or a replacement can be installed. The top drive itself may require partial disassembly in order to replace the quill. Second, due to the extensive size and weight of the quill, handling charges and repair bills can be significant. Additionally, the replacement cost of the quill is very high due to its size and complexity of manufacturing.

SUMMARY

A saver sub assembly is described herein. The saver sub assembly attaches to the main quill in a load-bearing, non-damaging manner such that quick replacement is possible.

The saver sub assembly has three components. A split ring with a series of grooves carries the weight of the drill string in the well bore, a body with a series of splines transmits torque through the connection, and two O-rings provide a seal and prevent drilling fluids from escaping within the borehole of the quill.

The saver sub assembly has a body capable of coupling with the quill, and a split ring capable of coupling with the quill and the body and capable of keeping the quill and body together. The body has splines to prevent relative rotation between the quill and the body. The body may be hollow, and/or have a split ring retainer to maintain the position of the split ring. The saver sub assembly may also have one or more O-rings positioned between the body and the quill. The body of the saver sub assembly may have a threaded pin for engaging a drill string.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
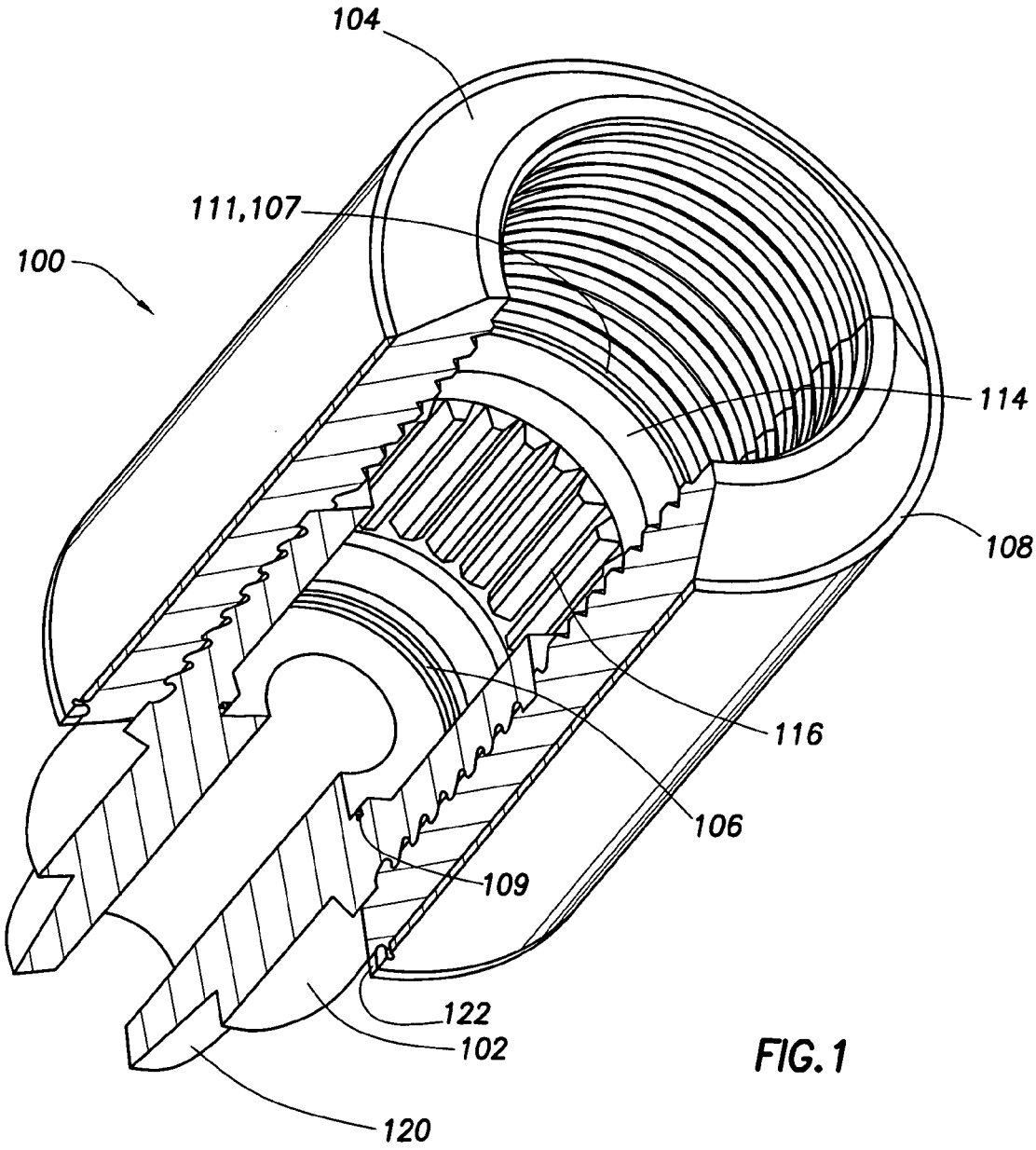
FIG. 1 is a partially cut away perspective view of a saver sub assembly in accordance with one embodiment of the present invention.

Referring to FIG. 1, shown therein is a quill saver sub assembly 100 for coupling a quill 200 (shown in FIG. 2) to a drill string (not shown). The quill saver sub assembly 100 has a hollow body 102, a split ring 104, O-rings 106 and 107, and a split ring retainer 108. The quill 200 engages the body 102 and the split ring 104 fits around both the quill 200 and the body 102. The split ring retainer 108 secures the split ring 104 in place. The O-rings 106, 107 seal the connection, allowing for the passage of fluid through the interior of the quill 200 and the body 102.

Figure 2:
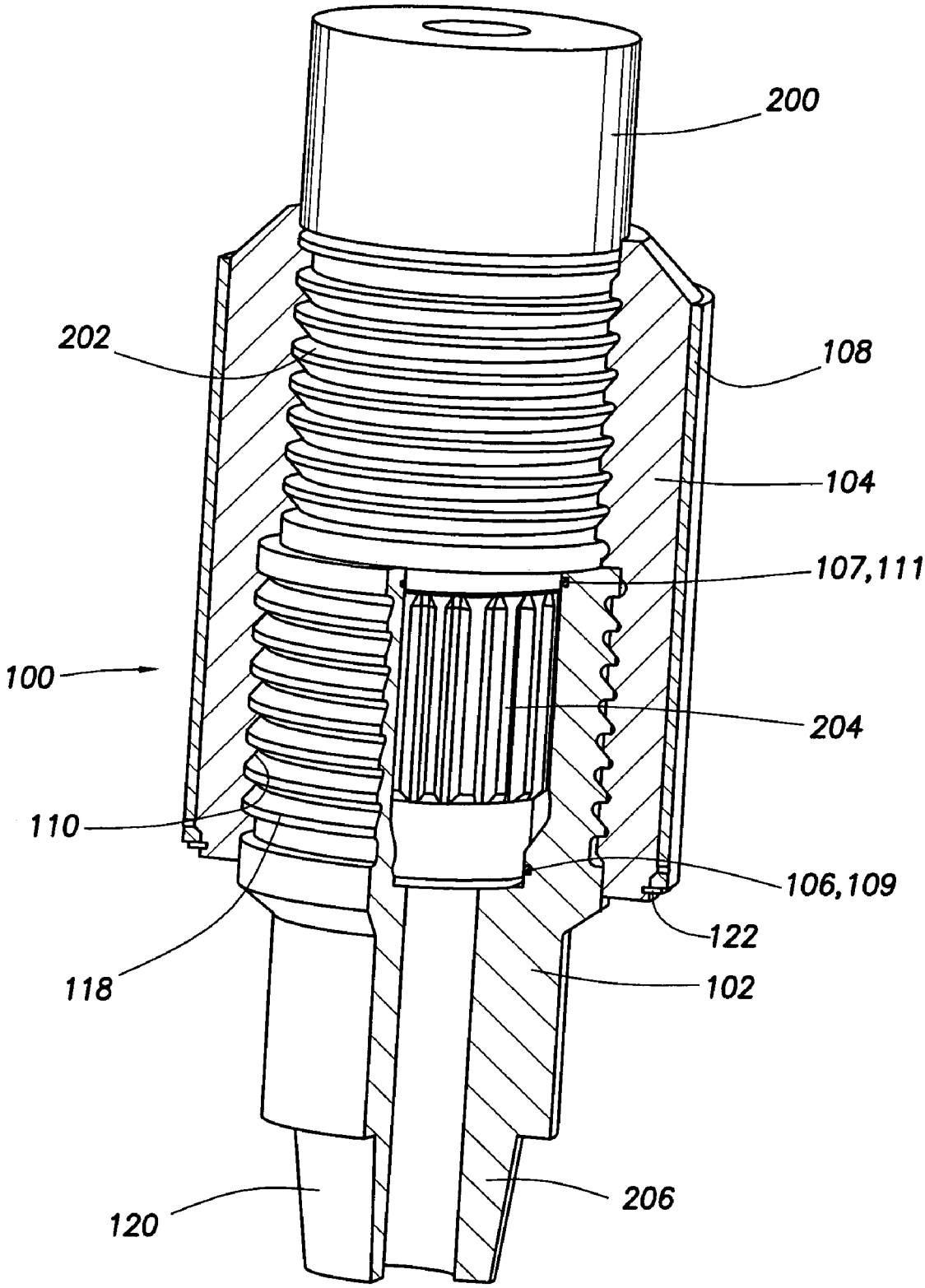
FIG. 2 is a partially cut away perspective view of the saver sub assembly of FIG. 1 attached to a quill.
Figure 3:
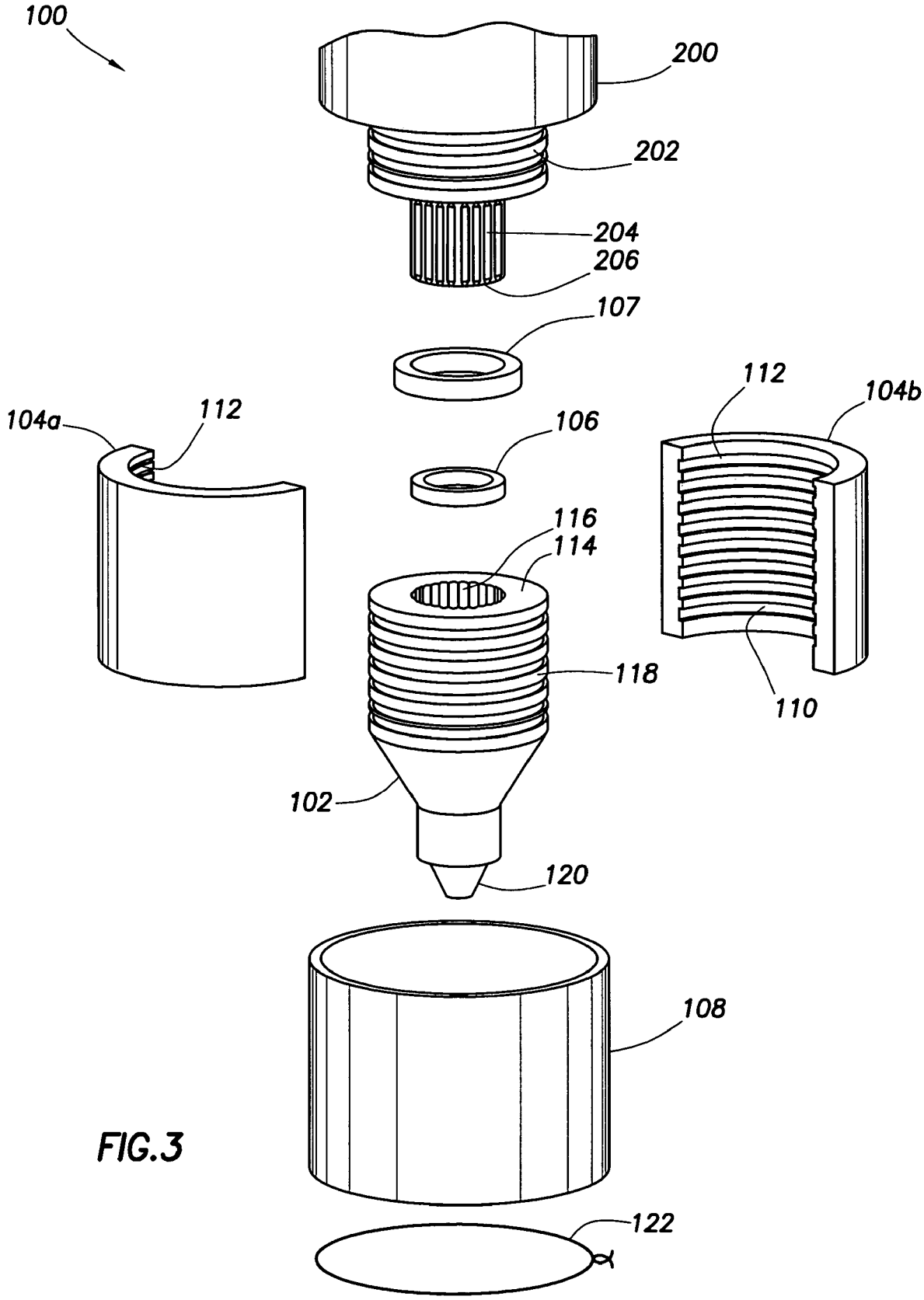
FIG. 3 is an exploded view of the saver sub assembly and quill of FIG. 2.
Figure 4:
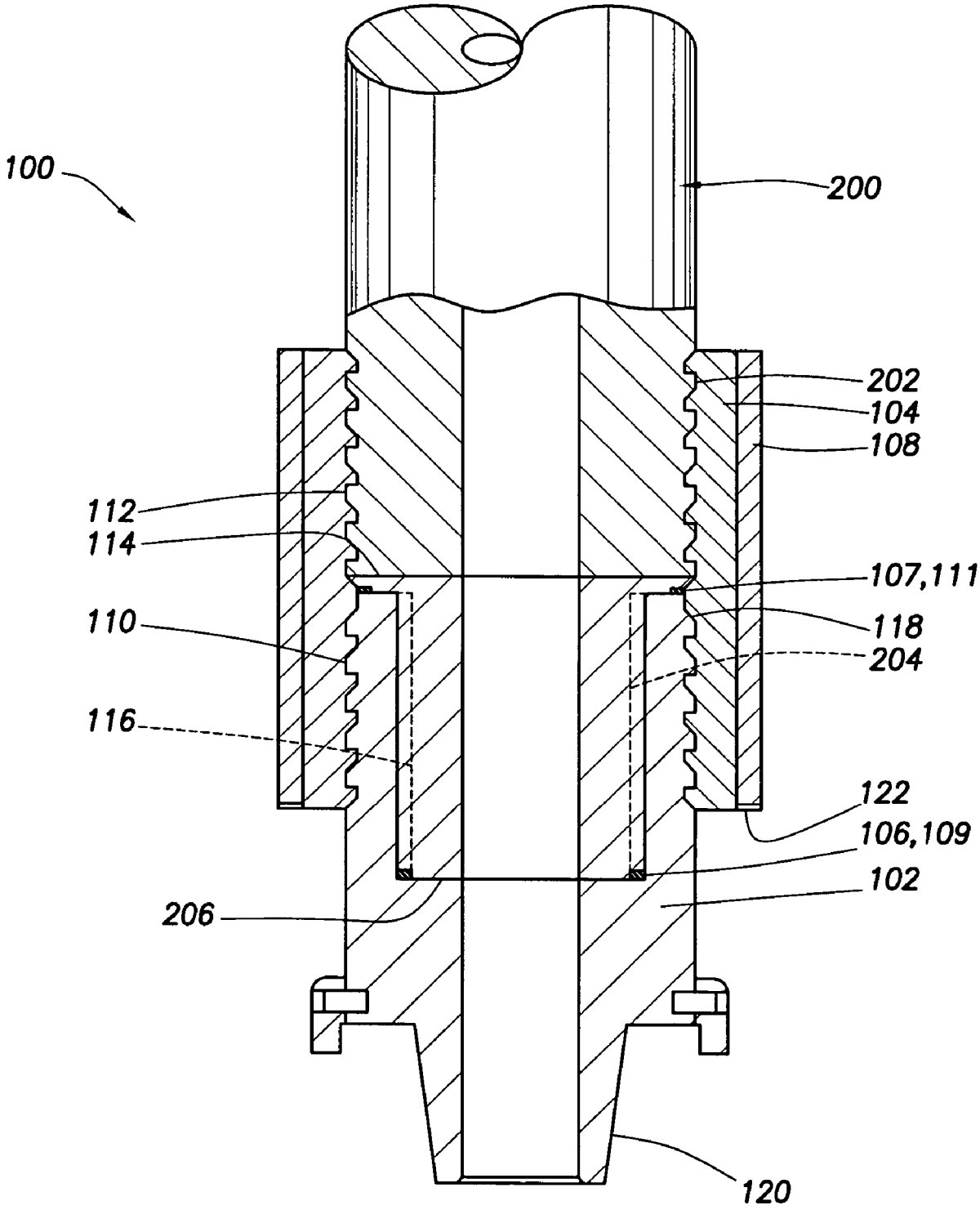
FIG. 4 is a side cross sectional view of the saver sub assembly of FIG. 2.
Figure 5B:
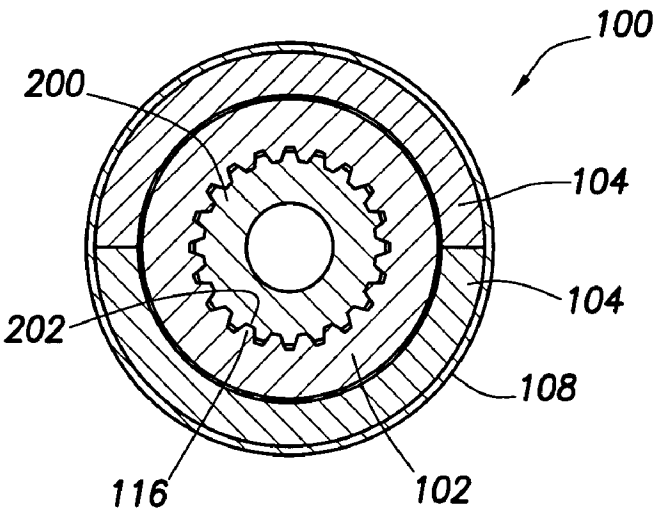
FIG. 5B is a top cross sectional view of the saver sub assembly of FIG. 5A, taken along line A-A.
Figure 5A:
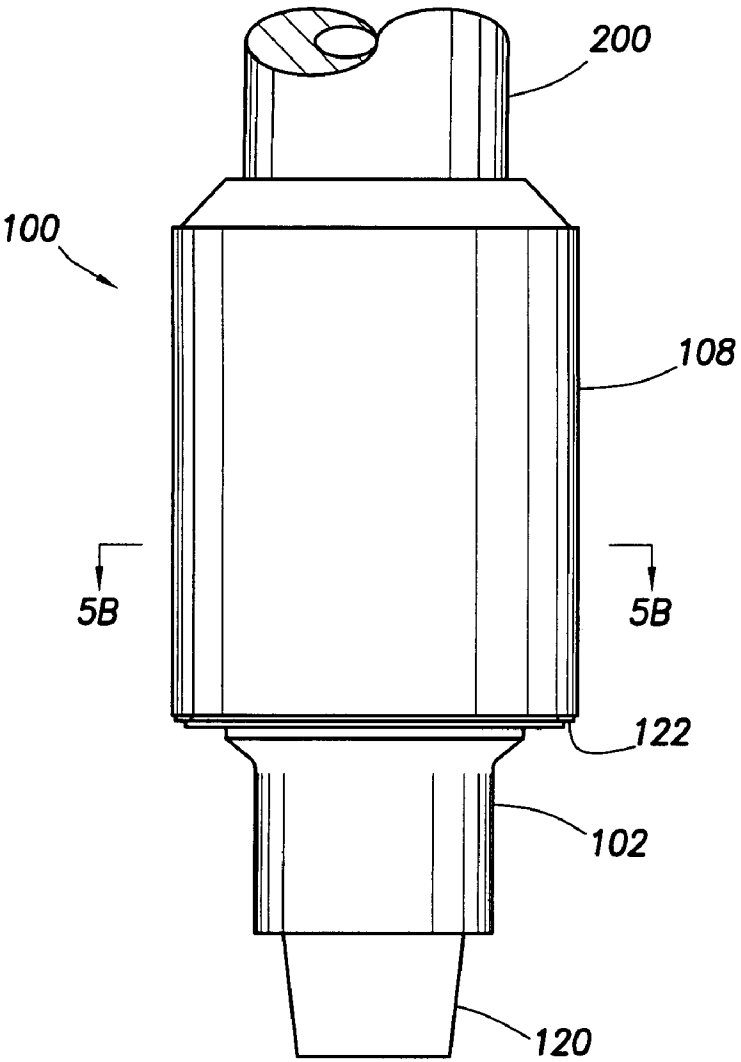
FIG. 5A is a side view of the saver sub assembly of FIG. 2.

FIG. 2 shows the quill saver sub assembly 100 secured to the quill 200 and FIG. 3 shows an exploded view of the quill saver sub assembly 100 and the quill 200. FIG. 4 shows a side-cross sectional view of the quill saver sub assembly 100 secured to the quill 200, and FIG. 5A shows a side view of the quill saver sub assembly 100. FIG. 5B shows a top sectional view of the quill saver sub assembly 100 secured to the quill 200. Referring to FIGS. 2, 3, 4, 5A, and 5B, the quill 200 has circumferential grooves 202 and quill splines 204. The quill splines 204 correspond to body splines 116 extending along the body 102. When the quill 200 engages the body 102, the quill splines 204 and the body splines 116 prevent relative rotation between the quill 200 and the body 102.

The body 102 has grooves 118 extending around a portion of the outer surface. The split ring 104 has lower ridges 110 and upper ridges 112 on the interior. The lower ridges 110 correspond to the grooves 118 of the body 102, and the upper ridges 112 correspond to the grooves 202 of the quill 200. The lower ridges 110 and the upper ridges 112 engage the grooves 118 of the body 102 and the grooves 202 of the quill 200, and support the weight of the drill string. After the quill 200 engages the body 102, the split ring 104 encircles the quill 200 and the body 102 and secures in place. A split ring retainer 108 secures the split ring 104 in place.

The split ring retainer 108 may be a sleeve sized to move into place only when the split ring 104 has properly engaged the quill 200 and the body 102. The split ring retainer 108 may be held in place with a retainer ring 122, such as a snap ring, a split ring, or any other device that would prevent the split ring retainer 108 from moving away from the split ring 104. Alternatively, the split ring retainer 108 may be any device suitable for holding the split ring 104 in a closed position, such as, but not limited to, one or more bolts or bands.

Prior to attaching the quill 200 to the body 102, the O-rings 106, 107 may be placed. One of the O-rings 106 fits between a quill bottom 206 and the body 102, and another one of the O-rings 107 fits between a body top 114 and the quill 200. The O-rings 106, 107 fit in pilots 109, 111 formed in the quill 200 and in the body 102. The pilots ensure that the O-rings 106, 107 are properly placed, and that the quill 200 and the body 102 are concentric. The O-rings 106, 107 provide a seal for fluid passing inside of the quill 200 and the body 102, and prevent fluid from leaking into and potentially damaging the area between the quill 200 and the body 102. Specifically, the O-rings 106, 107 protect the body splines 116 and the quill splines 204 from wear caused by fluid.

The body 102 also has a threaded pin 120, for connecting to the drill string (not shown). The threaded pin 120 may be used to connect the quill saver sub assembly 100 to operating components, including valves, drill pipe, or tools. The threaded pin 120 is sized to fit the drill string, and may vary, depending on the application. For instance, one body 102 having a first size of threaded pin 120 may be used for one part of the drill string, and another body 102 having a different size of threaded pin 120 may be used for another part of the drill string.

The quill saver sub assembly 100 easily attaches to the quill 200. First, the quill 200 couples with the body 102, with O-rings 106, 107 situated between. The split ring 104 then moves into place, so that it encircles part of the quill 200 and the body 102. The lower ridges 110 and upper ridges 112 of the split ring 104 engage the exterior 118 of the body 102 and the grooves 202 of the quill 200. Then, the split ring retainer 108 moves into place, around the split ring 104.

Removing the quill saver sub assembly 100 involves similar steps. First, the split ring retainer 108 moves either upwardly or downwardly away from the split ring 104. The split ring 104 then opens and moves away from the body 102 and the quill 200. The quill 200 and the body 102 then separate by sliding them apart.

The quill 200 is only exposed to possible damage when the quill saver sub assembly 100 is replaced. Since the quill 200 and the quill saver sub assembly 100 do not have threads that twist together, the quill saver sub assembly 100 can be removed and replaced without the need for suitable torquing. This makes damage to the quill 200 less likely, even when the quill saver sub assembly 100 is replaced. Therefore, the quill saver sub assembly 100 can be quickly replaced if damaged, or simply for a different size threaded pin 120.

The use of the quill saver sub assembly 100 prevents the expensive process of replacing the quill 200. The design allows for the quick disconnect of the quill saver sub assembly 100 as an alternative to the total replacement of the quill 200. The design of the quill saver sub assembly 100 provides the customer with some choice as to thread connection. If, for example, the customer requires a 7⅝" API or 8⅝" API, the customer need only replace the quill saver sub assembly 100 without having to buy and replace the quill 200.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A saver assembly for a quill, wherein the quill comprises external grooves, comprising:

a body capable of coupling with the quill, wherein the body comprises external grooves;

a split ring having circumferential ridges for engaging the grooves of the quill and the body and being capable of keeping the quill and body together; and a split ring retainer to maintain a desired position of the split ring;

wherein the body has internal splines to prevent relative rotation between the quill and the body, and wherein the body splines engage external splines on the quill.

2. The saver assembly of claim 1, wherein the body is hollow.

3. The saver assembly of claim 1, further comprising a retainer ring to maintain the position of the split ring retainer.

4. The saver assembly of claim 1, further comprising one or more O-rings positioned between the body and the quill.

5. The saver assembly of claim 1, wherein the body has a threaded pin for engaging a drill string.

6. The saver assembly of claim 1, wherein the ridges are comprised of upper ridges for engaging the quill and lower ridges for engaging the body.

7. The saver assembly of claim 6, wherein the body grooves are capable of engaging the lower ridges of the split ring.

8. The saver assembly of claim 6, wherein the upper ridges are capable of engaging grooves on the quill.

9. A saver assembly for a quill, comprising:

a hollow body capable of coupling with the quill;

a split ring capable of coupling with the quill and the body and capable of keeping the quill and body together;

a split ring retainer to maintain the position of the split ring;

a retainer ring to maintain the position of the split ring retainer; and one or more O-rings positioned between the body and the quill;

wherein the hollow body has a threaded pin for engaging a drill string; wherein the interior of the split ring has upper circumferential ridges for engaging external grooves on the quill and lower circumferential ridges for engaging external grooves on the body; and wherein the quill has external splines corresponding to internal splines extending along a portion of the body, such that when the quill couples with the body, the quill splines and the body splines prevent relative rotation between the quill and the body.

10. A method for coupling a saver assembly with a quill, the method comprising:

providing the quill, wherein the quill comprises external grooves;

providing the saver assembly comprising a body capable of coupling with the quill, wherein the body comprises external grooves, a split ring capable of coupling with the grooves of the quill and the body and capable of keeping the quill and body together, and a split ring retainer, wherein the body and the quill each have opposing splines to prevent relative rotation between the quill and the body;

coupling the opposing splines of the quill and the body of the saver assembly to prevent the relative rotation thereof;

then securing the split ring about the quill and the body; and securing the split ring retainer about the split ring.

11. The method of claim 10, wherein coupling the quill and the body takes place before securing the split ring.

12. The method of claim 10, wherein coupling the quill and the body takes place before securing the split ring and securing the split ring takes place before securing the split ring retainer.

13. The method of claim 10, wherein the saver assembly further comprises a retainer ring, the method further comprising securing the retainer ring.

14. The method of claim 13, wherein coupling the quill and the body takes place before securing the split ring, securing the split ring takes place before securing the split ring retainer, and securing the split ring retainer takes place before securing the retainer ring.

15. The method of claim 13, wherein the saver assembly further comprises O-rings, the method further comprising placing the O-rings between the body and the quill.

16. The method of claim 15, wherein placing the O-rings takes place before coupling the quill and the body, coupling the quill and the body takes place before securing the split ring, securing the split ring takes place before securing the split ring retainer, and securing the split ring retainer takes place before securing the retainer ring.

* * * * *